US007423616B2

(12) United States Patent
Ogawa et al.

(10) Patent No.: US 7,423,616 B2
(45) Date of Patent: Sep. 9, 2008

(54) PLASMA DISPLAY PANEL DRIVE METHOD

(75) Inventors: Kenji Ogawa, Osaka (JP); Shigeo Kigo, Osaka (JP); Kenji Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 554 days.

(21) Appl. No.: 10/509,033

(22) PCT Filed: Dec. 11, 2003

(86) PCT No.: PCT/JP03/15856

§ 371 (c)(1),
(2), (4) Date: Sep. 27, 2004

(87) PCT Pub. No.: WO2004/055770

PCT Pub. Date: Jul. 1, 2004

(65) Prior Publication Data

US 2005/0168404 A1 Aug. 4, 2005

(30) Foreign Application Priority Data

Dec. 13, 2002 (JP) ..... 2002-362050

(51) Int. Cl.
*G09G 3/28* (2006.01)

(52) U.S. Cl. ..... 345/63

(58) Field of Classification Search ..... 345/60–71; 315/169.3

See application file for complete search history.

(56) References Cited

U.S. PATENT DOCUMENTS 6,011,355 A * 1/2000 Nagai ..... 315/169.3
6,104,362 A * 8/2000 Kuriyama et al. ..... 345/63
6,369,781 B2 * 4/2002 Hashimoto et al. ..... 345/60
6,686,698 B2 * 2/2004 Takeuchi et al. ..... 315/169.2
2004/0233131 A1 11/2004 Kang et al. ..... 315/169.3

FOREIGN PATENT DOCUMENTS

| | | |
|---|---|---|
| JP | 11-15436 | 1/1999 |
| JP | 11-85099 | 3/1999 |
| JP | 2000-322025 | 11/2000 |
| JP | 2001-60074 | 3/2001 |
| JP | 2002-162932 | 6/2002 |
| JP | 2002-351396 | 12/2002 |

* cited by examiner

*Primary Examiner*—Bipin Shalwala
*Assistant Examiner*—Steven E Holton
(74) *Attorney, Agent, or Firm*—Wenderoth, Lind & Ponack, LLP

(57) ABSTRACT

A method of driving a plasma display panel including discharge cells, each at an intersection of a scan electrode and a sustain electrode, and a data electrode. One field period is divided into a plurality of sub-fields, each having an initializing period, writing period, and sustaining period. The sustaining period of at least one sub-field has a first sustaining period and a second sustaining period. In the first sustaining period, a transition period of a sustain pulse applied to the scan electrode is not temporally overlapped with a transition period of a sustain pulse applied to the sustain electrode. In a second sustaining period, a transition period of the sustain pulse applied to the scan electrode is temporally overlapped with a transition period of the sustain pulse applied to the sustain electrode. The second sustaining period is included at least at the end of the sustaining period.

1 Claim, 7 Drawing Sheets

PRIOR ART

PLASMA DISPLAY PANEL DRIVE METHOD

CROSS-REFERENCES TO RELATED APPLICATIONS

This application is the National Stage of International Application No. PCT/JP2003/015856, filed Dec. 11, 2003.

BACKGROUND OF THE INVENTION

1. Field of the Invention

The present invention relates to a method of driving a plasma display panel used as a thin display device having a large screen and light weight.

2. Description of the Related Art

An alternating current surface-discharging panel representing a plasma display panel (hereinafter abbreviated as a panel) has a plurality of discharge cells formed between facing front and rear panels. In the front panel, a plurality of display electrodes, each formed of a pair of scan electrode and sustain electrode, are formed on a front glass substrate in parallel with each other. A dielectric layer and a protective layer are formed to cover these display electrodes. On the other hand, in the rear panel, a plurality of data electrodes is formed in parallel with each other on a rear glass substrate. A dielectric layer is formed on the data electrodes to cover them. Further, a plurality of barrier ribs are formed on the dielectric layer in parallel with the data electrodes. Phosphor layers are formed on the surface of the dielectric layer and the side faces of the barrier ribs. Then, the front panel and the rear panel are arranged to face each other and are sealed together so that the display electrodes and data electrodes intersect with each other and a discharge gas is filled into an internal discharge space formed therebetween. A discharge cell is formed at a part where a display electrode is faced with a corresponding data electrode. In a panel structured as above, ultraviolet light is generated by gas discharge in each discharge cell. This ultraviolet light excites respective phosphors to emit R, G, or B color, for color display.

A general method of driving a panel is a so-called sub-field method: one field period is divided into a plurality of sub-fields and combination of light-emitting sub-fields provides gradation images for display. Among such sub-field methods, a novel driving method of minimizing light emission unrelated to gradation representation to improve a contrast ratio is disclosed in Japanese Patent Unexamined Publication No. 2000-242224.

FIG. 8 shows an example of driving waveforms of a conventional plasma display panel with an improved contrast ratio. These driving waveforms are described hereinafter. One field period is composed of n sub-fields, each having an initializing period, writing period, and sustaining period. The sub-fields are abbreviated as a first SF, second SF, and so on to an n-th sub-field. As described below, in sub-fields except the first SF among these n sub-fields, initializing operation is performed only on discharge cells that have been lit during the sustaining period of the previous sub-field.

In the former half of the initializing period of the first SF, application of a gradually-increasing ramp voltage to scan electrodes causes weak discharge so that wall electric charge necessary for writing operation is provided on each electrode. At this time, in order to optimize the wall electric charge afterwards, excessive wall electric charge is provided. In the following latter half of the initializing period, application of a gradually-decreasing ramp voltage to the scan electrodes causes weak discharge again, to weaken the wall electric charge excessively stored on each electrode and adjust the wall electric charge to a value appropriate for each discharge cell.

In the writing period of the first SF, writing discharge is caused in discharge cells to be lit. In the sustaining period of the first SF, sustain pulses are applied to scan electrodes and sustain electrodes to cause sustaining discharge in the discharge cells in which writing discharge has occurred. Thus, the phosphors of the corresponding discharge cells emit light for image display.

In the following initializing period of the second SF, the same driving waveforms as the latter half of the initializing period of the first SF, i.e. a gradually-decreasing ramp voltage, is applied to the scan electrodes. This is because the wall charge necessary for writing operation is provided at the time of sustaining charge and thus the former half of the initializing period need not be provided independently. Therefore, weak discharge occurs in the discharge cells in which sustaining discharge has occurred in the first SF, to weaken the wall discharge excessively stored on each electrode and adjust the wall discharge to a value appropriate for each discharge cell. In discharge cells in which no sustaining discharge has occurred, the wall charge at the time of completion of the initializing period of the first SF is maintained. Thus, discharge does not occur.

As described above, the initializing operation in the first SF is an all-cell initializing operation in which all the cells are discharged. The initializing operation in the second SF or after is a selective initializing operation in which only discharge cells subjected to sustaining discharge are initialized. For this reason, light emission unrelated to display is weak discharge occurring in the initializing operation of the first SF only. Thus, images with high contrast can be displayed.

However, in spite of display of images with high contrast, the above driving method has a problem of increasing voltage applied to the data electrodes in order to ensure the wiring discharge.

The present invention addresses the above problem and aims to provide a method of driving a plasma display panel capable of displaying images with high contrast without increasing the voltages applied to the data electrodes.

DISCLOSURE OF THE INVENTION

To attain the above object, a method of driving a plasma display panel of the present invention includes: dividing one field period into a plurality of sub-fields, each having an initializing period, writing period, and sustaining periods; and providing a first sustaining period and a second sustaining period in a sustaining period of at least one sub-field. In the first sustaining period, a transition period of sustain pulses applied to scan electrodes and a transition period of sustain pulses applied to sustain electrodes are not temporally overlapped with each other. In the second sustaining period, a transition period of sustain pulses applied to the scan electrodes and a transition period of sustain pulses applied the sustain electrodes are temporally overlapped with each other. The second sustaining period is included at least at the end of the sustaining period.

DETAILED DESCRIPTION OF PREFERRED EMBODIMENT

An exemplary embodiment of the present invention is described hereinafter with reference to the accompanying drawings.

Figure 1:
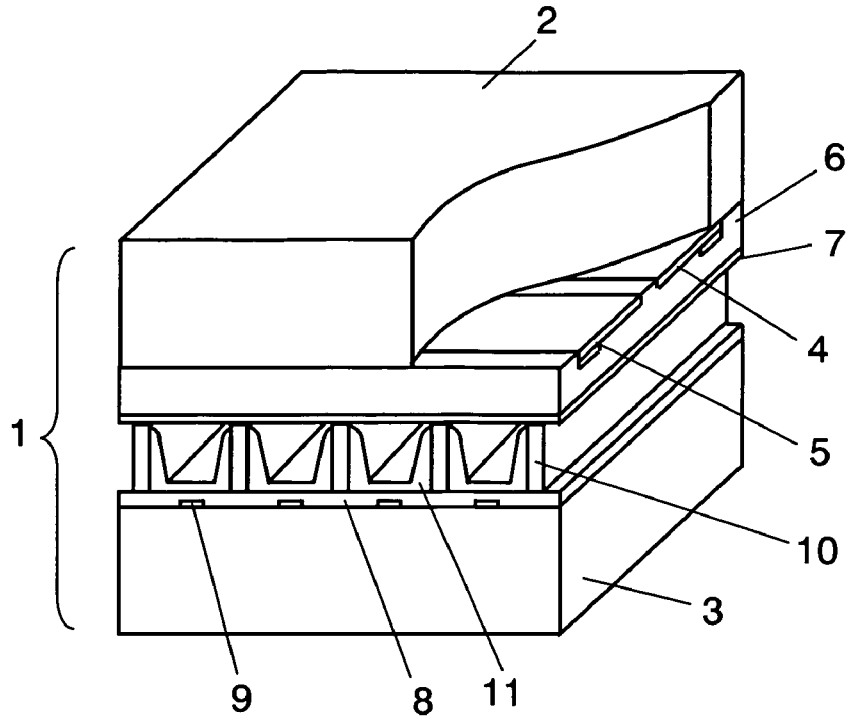
FIG. 1 is a perspective view illustrating a part of a plasma display panel in accordance with an exemplary embodiment of the present invention.

FIG. 1 is a perspective view illustrating a part of a plasma display panel in accordance with the exemplary embodiment of the present invention. Panel 1 is composed of front substrate 2 and rear substrate 3 that are made of glass and are arranged to face each other so as to form a discharge space therebetween. On front substrate 2, a plurality of display electrodes, each formed of a pair of scan electrode 4 and sustain electrode 5, is formed in parallel with each other. Dielectric layer 6 is formed to cover scan electrodes 4 and sustain electrodes 5. On dielectric layer 6, protective layer 7 is formed. On the other hand, on rear substrate 3, a plurality of data electrodes 9 covered with insulating layer 8 is provided. Barrier ribs 10 are provided on insulating layer 8 between data electrodes 9 in parallel therewith. Also, phosphor 11 is provided on the surface of insulating layer 8 and the side faces of barrier ribs 10. Front substrate 2 and rear substrate 3 are arranged to face each other in a direction in which scan electrodes 4 and sustain electrodes 5 intersect with data electrodes 9. In a discharge space formed therebetween, a mix gas, e.g. neon-xenon, is filled as a discharge gas.

Figure 2:
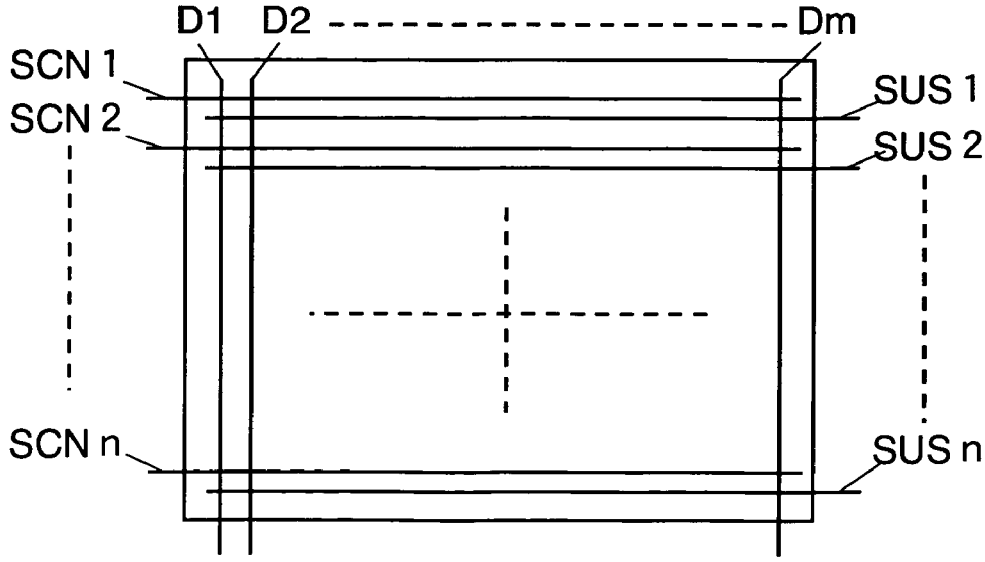
FIG. 2 is a diagram illustrating an array of electrodes in the plasma display panel.

FIG. 2 is a diagram showing an array of electrodes on the panel. N scan electrodes SCN 1 to SCNn (scan electrodes 4 in FIG. 1) and n sustain electrodes SUS 1 to SUSn (sustain electrodes 5 in FIG. 1) are alternately disposed in a row direction. M data electrodes D1 to Dm (data electrodes 9 in FIG. 1) are disposed in a column direction. A discharge cell is formed at a portion in which a pair of scan electrode SCNi and sustain electrode SUSi (i=1 to n) intersects with one data electrode Dj (j=1 to m). Thus, m×n discharge cells are formed in the discharge space.

Figure 3:
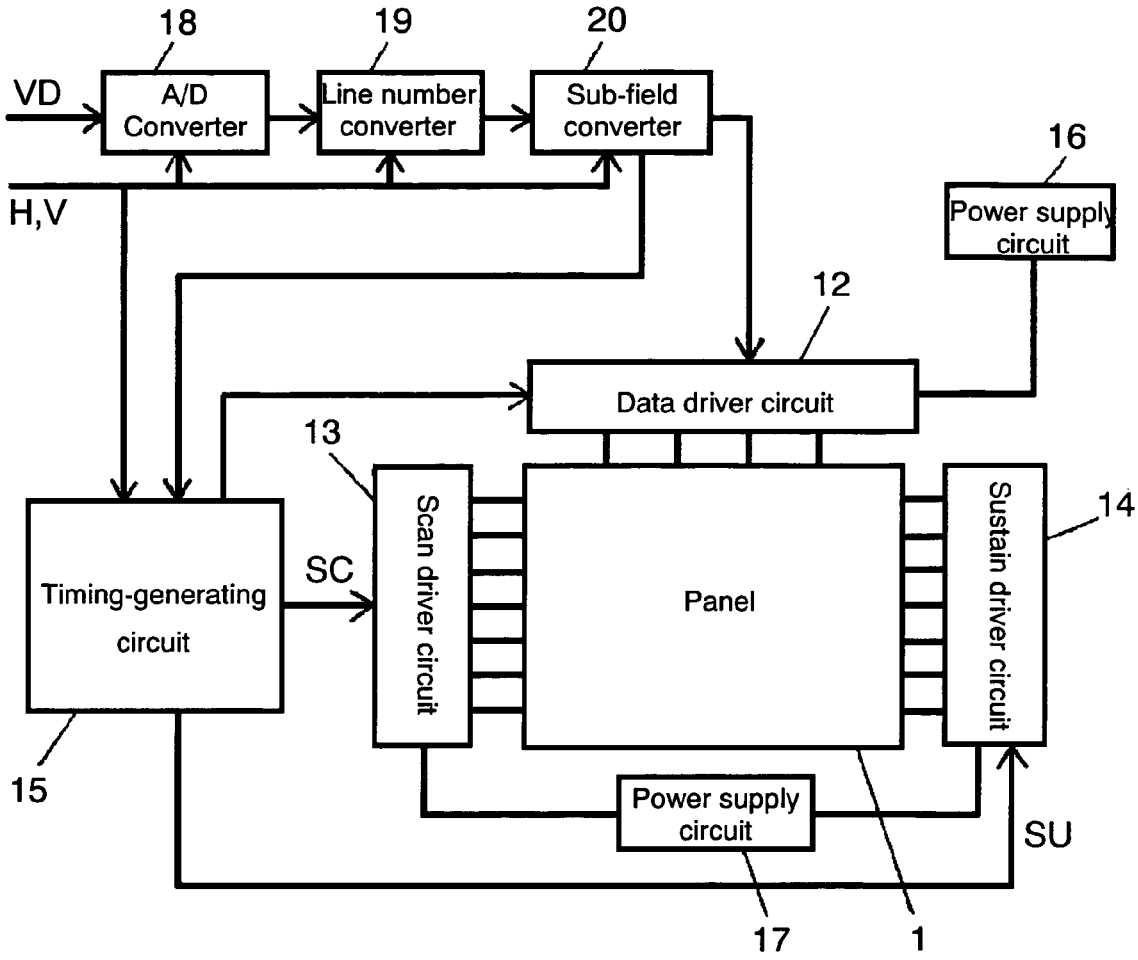
FIG. 3 is a diagram illustrating a structure of a plasma display device using a driving method in accordance with the exemplary embodiment of the present invention.

FIG. 3 is a diagram illustrating a structure of a plasma display device using a driving method of the exemplary embodiment of the present invention. The plasma display device includes panel 1, data driver circuit 12, scan driver circuit 13, sustain driver circuit 14, timing-generating circuit 15, power supply circuits 16 and 17, analog-to-digital (A/D) converter 18, line number converter 19, and sub-field converter 20.

With reference to FIG. 3, video signal VD is fed into A/D converter 18. Horizontal synchronizing signal H and vertical synchronizing signal V are fed into timing-generating circuit 15, A/D converter, line number converter 19, and sub-field converter 20. A/D converter 18 converts video signal VD into image data of digital signals, and feeds the digital image data into line number converter 19. Line number converter 19 converts the image data into image data corresponding to the number of pixels of panel 1, and feeds the image data to sub-field converter 20. Sub-field converter 20 divides the image data of respective pixels into a plurality of bits corresponding to a plurality of sub-fields. The image data per sub-field is fed into data driver circuit 12. Data driver circuit 12 converts the image data per sub-field into signals corresponding to respective data electrodes D1 to Dm. Then, responsive to the signals, data driver circuit 12 supplies voltages of power supply circuit 16 to respective electrodes.

Timing-generating circuit 15 generates timing signals SC and SU based on horizontal synchronizing signal H and vertical synchronizing signal V, and feeds the timing signals into scan driver circuit 13 and sustain driver circuit 14, respectively. The scan driver circuit 13 and sustain driver circuit 14 are connected to power supply circuit 17. Responsive to timing signal SC, scan driver circuit 13 feeds driving waveforms into scan electrodes SCN1 to SCNn. Responsive to timing signal SU, sustain driver circuit 14 feeds driving waveforms into sustain electrodes SUS1 to SUSn.

Figure 4:
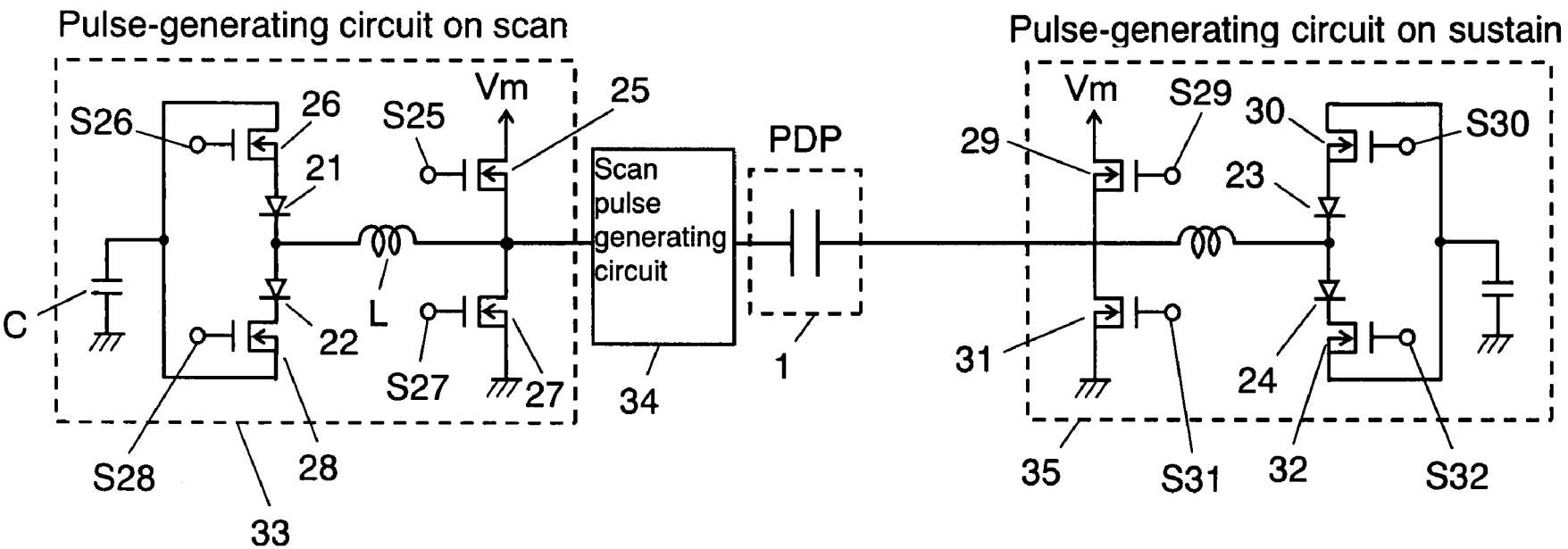
FIG. 4 shows an example of a driving circuit diagram for generating sustain pulses in the plasma display device.

FIG. 4 shows an example of a driving circuit diagram for generating sustain pulses in scan driver circuit 13 and sustain driver circuit 14. A description is provided of sustain pulse generating circuit 33 on a scan electrode side. Switching elements 25 and 27 apply voltages directly to scan electrodes SCN1 to SCNn from power supply source Vm or GND. Capacitor C, coil L, switching elements 26 and 28, and diodes 21 and 22 constitute a power recovering circuit for applying voltages to scan electrodes SCN1 to SCNn without power consumption by causing the capacity of the scan electrodes and coil L to resonate. Diodes 21 and 22 prevent current backflow. Switching elements 25 to 28 are turned on when an input signal is at a high level.

Sustain pulse generating circuit 35 on a sustain electrode side works in the same manner. In other words, switching elements 29 to 32 correspond to switching elements 25 to 28, and diodes 23 and 24 to diodes 21 and 22, respectively. These components constitute a circuit for applying voltages to sustain electrodes SUS1 to SUSn. Sustain pulse generating circuit 33 on the scan electrode side is coupled to scan electrodes SCN1 to SCNn on panel 1 via scan pulse generating circuit 34.

Figure 5:
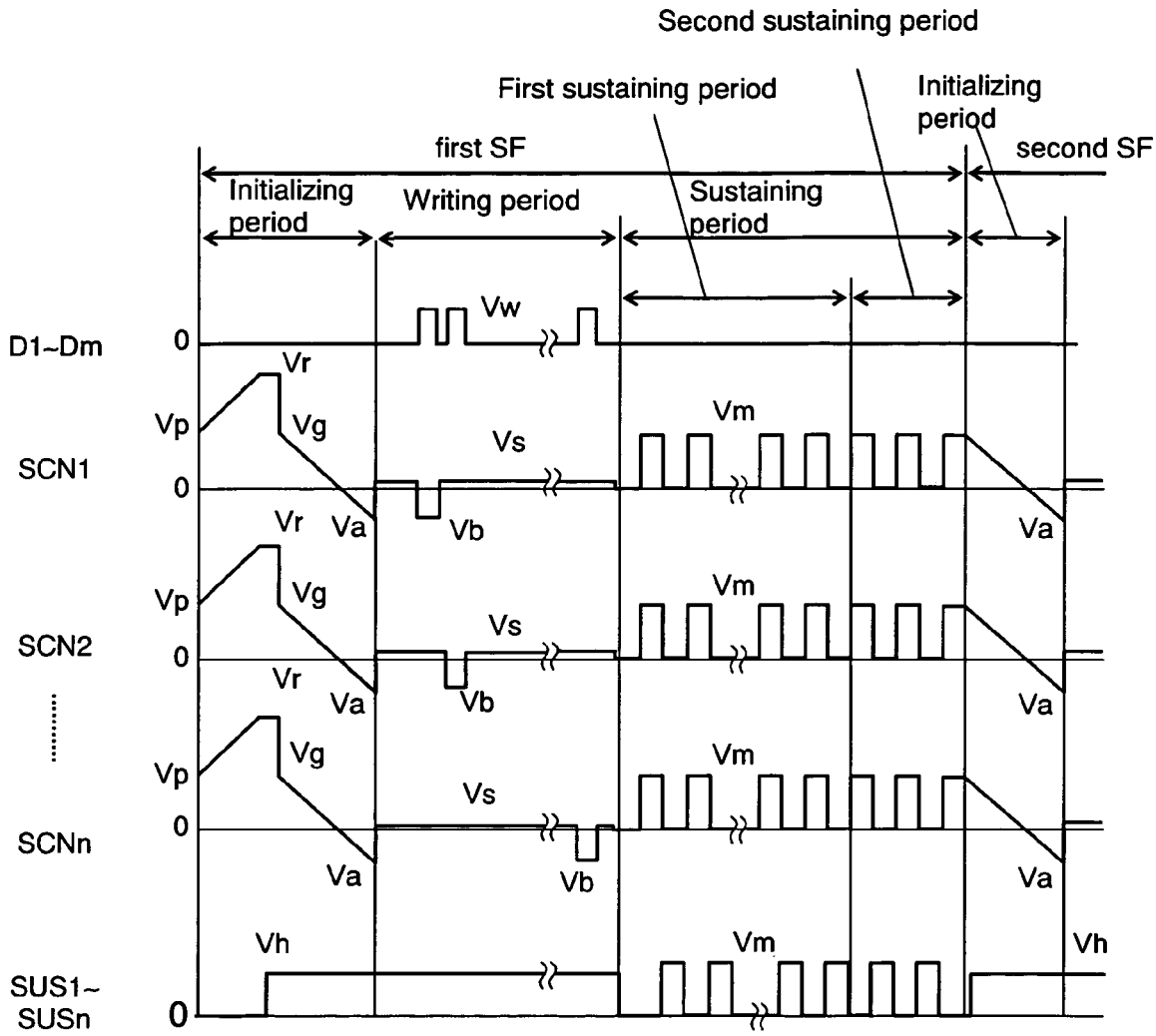
FIG. 5 is a diagram showing driving waveforms applied to respective electrodes of a plasma display panel in accordance with the exemplary embodiment of the present invention.

Next, a description is provided of driving waveforms for driving panel 1. FIG. 5 is a diagram showing driving waveforms applied to respective electrodes of a plasma display panel in accordance with the exemplary embodiment of the present invention. The diagram shows driving waveforms from the first SF to the second SF.

In the initializing period of the first SF, while data electrodes D1 to Dm and sustain electrodes SUS1 to SUSn are kept at 0V, a ramp voltage gradually increasing from voltage Vp (V) not higher than a discharge-starting voltage to voltage Vr (V) exceeding the discharge-starting voltage is applied to scan electrodes SCN1 to SCNn. This causes a first weak initializing discharge in all the discharge cells. Thus, negative wall voltage accumulates on scan electrodes SCN1 to SCNn and positive wall voltage accumulates on sustain electrodes SUS1 to SUSn and data electrodes D1 to Dm. Now, the wall voltage on electrodes indicates a voltage generated by wall electric charge that accumulates on the dielectric layer or phosphor layer covering the electrodes.

Thereafter, sustain electrodes SUS1 to SUSn are kept at positive voltage Vh (V), and a ramp voltage gradually decreasing from voltage Vg (V) to voltage Va(V) is applied to scan electrodes SCN1 to SCNn. This causes a second weak initializing discharge in all the discharge cells. The wall voltage on scan electrodes SCN1 to SCNn and the wall voltage on sustain electrodes SUS1 to SUSn are weakened, and the wall voltage on data electrodes D1 to Dm are adjusted to a value appropriate for writing operation.

In this manner, in the initializing period of the first SF, all-cell initializing operation in which initializing discharge occurs in all the discharge cells is performed.

In the writing period of the first SF, scan electrodes SCN1 to SCNn are held at voltage Vs (V) once. Next, positive write pulse voltage Vw (V) is applied to data electrode Dk of discharge cells to be lit in the first row among data electrodes D1 to Dm, and scan pulse voltage Vb (V) is applied to scan electrode SCN1 in the first row. At this time, the voltage at the intersection between data electrode Dk and scan electrode SCN1 totally amounts to the value in which the wall voltage on data electrode Dk and the wall voltage on scan electrode SCN1 are added to voltage Vw-Vb applied from outside, thus exceeding the discharge-starting voltage. This causes writing discharge between data electrode Dk and scan electrode SCN1, and between sustain electrode SUS1 and scan electrode SCN1. Thus, positive wall voltage accumulates on scan electrode SCN1, negative wall voltage accumulates on sustain electrode SUS1, and negative wall voltage also accumulates on data electrode Dk in this discharge cell. Thus, writing operation in which writing discharge occurs in the discharge cells to be lit in the first row to accumulate wall voltage on respective electrodes is performed.

On the other hand, the intersection of a data electrode to which positive write pulse voltage Vw (V) is not applied, and scan electrode SCN1 does not exceed the discharge-starting voltage. Thus no writing discharge occurs in this intersection.

Such writing operation is sequentially performed on the cells in the second row to the n-th row, and the writing period is completed.

In the sustaining period of the first SF, first, sustain electrodes SUS1 to SUSn are reset to 0V, and positive sustain pulse voltage Vm (V) is applied to scan electrodes SCN1 to SCNn. At this time, in the discharge cells in which writing discharge has occurred, the voltage across scan electrode SCNi and sustain electrode SUSi amounts to addition of sustain pulse voltage Vm (V) and the wall voltage on scan electrode SCNi and sustain electrode SUSi, thus exceeding the discharge-starting voltage. This causes sustaining discharge between scan electrode SCNi and sustain electrode SUSi. Thus, negative wall voltage accumulates on scan electrode SCNi, positive wall voltage accumulates on sustain electrode SUSi. At this time, positive wall voltage also accumulates on data electrode Dk.

Successively, scan electrodes SCN1 to SCNn are reset to 0V, and positive sustain pulse voltage Vm (V) is applied to sustain electrodes SUS1 to SUSn. In the discharge cells in which sustaining discharge has occurred, the voltage across sustain electrode SUSi and scan electrode SCNi exceeds the discharge-starting voltage. This causes sustaining discharge between sustain electrode SUSi and scan electrode SCNi again. Thus, negative wall voltage accumulates on sustain electrode SUSi, positive wall voltage accumulates on scan electrode SCNi.

Applying sustain pulse alternately to scan electrodes SCN1 to SCNn and sustain electrodes SUS1 to SUSn in a similar manner can continue sustaining discharge. Incidentally, in the discharge cells in which no writing discharge has occurred in the writing period, no sustaining discharge occurs, and a state of the wall voltage at the time of completion of the initializing period is maintained. Thus, sustaining operation in the sustaining period is completed.

As shown in FIG. 5, the sustaining period is composed of a first sustaining period and a second sustaining period. This is a point of the present invention, and thus detailed afterwards.

Next, in the initializing period of the second SF, sustain electrodes SUS1 to SUSn are kept at voltage Vh (V), data electrodes D1 to Dm are kept at 0V, and a ramp voltage gradually decreasing from voltage Vm (V) to voltage Va(V) is applied to scan electrodes SCN1 to SCNn. This causes weak initializing discharge in the discharge cells in which sustaining discharge has occurred in the sustaining period of the first SF. The wall voltage on scan electrode SCNi and the wall voltage on sustain electrode SUSi are weakened, and the wall voltage on data electrode Dk are adjusted to a value appropriate for writing operation. On the other hand, in the discharge cells in which writing discharge or sustaining discharge has not occurred in the first SF, no discharge occurs and a state of the wall charge at the time of completion of the initializing period of the first SF is maintained. In this manner, in the initializing period of the second SF, selective initializing operation in which initializing discharge occurs in the discharge cells subjected to sustaining discharge in the first SF is performed.

The writing period and sustaining period of the second SF are the same as those of the first SF. Those of the third SF or after are the same as those of the second SF. Thus, the description is omitted. Desirably, the relative voltage change of the ramp voltage in the initializing period is up to 10 V/μs. In this embodiment, the relative voltage change is set to 2 to 3 V/μs, Va=−80V, Vh=150V, and Vm=170V.

Figure 6:
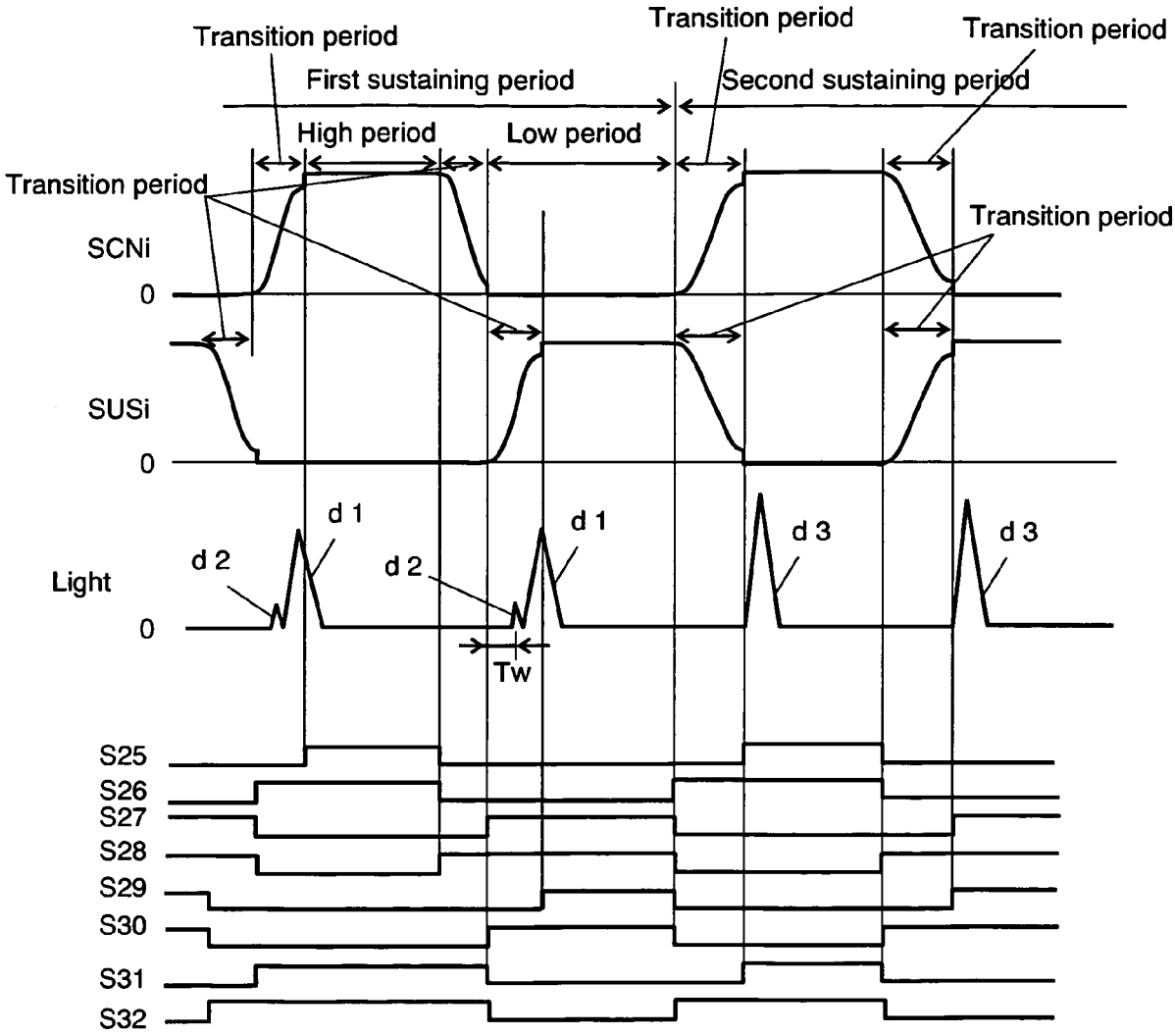
FIG. 6 is a diagram showing driving waveforms, light-emission waveforms, and control signal waveforms of switching elements in a sustaining period of the plasma display panel in accordance with the exemplary embodiment of the present invention.

Next, driving waveforms in the sustaining period are detailed. FIG. 6 is an enlarged diagram showing driving waveforms applied to scan electrode SCNi and sustain electrode SUSi in the sustaining period, i.e. sustain pulses, and a waveform of light emitted with the sustain pulses. Additionally, signals for controlling switching elements 25 to 32 of FIG. 4 are also shown as signals S25 to S32, respectively. As shown in the diagram, each of the sustain pulses applied to scan electrode SCNi or sustain electrode SUSi has a transition period (leading edge period) during which the sustain pulse changes from 0V to voltage Vm (V), a high period during which the sustain pulse is fixed at Vm (V), a transition period (trailing edge period) during which the sustain pulse changes from Vm (V) to 0V, and a low period during which the sustain pulse is fixed at 0V. In the description of a sustain pulse applied to scan electrode SCNi as an example, switching element 26 of FIG. 4 is turned on by setting signal S26 at a high level in the leading edge period. Electric charge accumulated in capacitor C for power recovering is supplied to scan electrode SCNi via coil L to increase the voltage on scan electrode SCNi. Next, in the high period, signal S25 at a high level turns on switching element 25, voltage Vm (V) of a power supply of Vm (V) is supplied to scan electrode SCNi, and the voltage of scan electrode SCNi is fixed to Vm (V). Next, in the trailing edge period, signals S25 and S26 at a low level and then signal S28 at a high level turns on switching element 28. Thus, the electric charge accumulated on scan electrode SCNi is recovered into capacitor C for power recovering via coil L, and the voltage of scan electrode SCNi decreases. Next, in the low period, signal S27 at a high level turns on switching element 27, thus grounding scan electrode SCNi and fixing to 0V. The same operation applies to sustain electrode SUSi.

The sustaining period is composed of the first sustaining period and the second sustaining period as shown in FIG. 5.

The detailed driving waveforms from the first sustaining period to the second sustaining period are shown in FIG. 6. With reference to FIG. 6, when sustain pulses are alternately applied to scan electrode SCNi and sustain electrode SUSi, in the first sustaining period, the transition period of a sustain pulse applied to scan electrode SCNi and the transition period of a sustain pulse applied to sustain electrode SUSi are not overlapped with each other. In the second sustaining period, the transition period of the sustain pulse applied to scan electrode SCNi and the transition period of the sustain pulse applied to sustain electrode SUSi are at least partially overlapped with each other temporally. Specifically, in the first sustaining period, after one of the display electrodes (e.g. scan electrode SCNi) is fixed at 0V, application of voltage to the other of the display electrodes (e.g. sustain electrode SUSi) starts. However, in the second sustaining period, sustain pulses are applied so that the trailing edge period of a pulse applied to one of the display electrodes (e.g. scan electrode SCNi) is overlapped with the leading edge period of a pulse applied to the other of the display electrodes (e.g. sustain electrode SUSi).

As described above, the method of driving a panel in accordance with the present invention has two sustaining periods: a first sustaining period in which the transition period of a sustain pulse applied to scan electrode SCNi is not temporally overlapped with the transition period of a sustain pulse applied to sustain electrode SUSi; and a second sustaining period in which the transition period of the sustain pulse applied to scan electrode SCNi is temporally overlapped with the transition period of the sustain pulse applied to sustain electrode SUSi. The second sustaining period is included at the end of the sustaining period. This structure stabilizes the following initializing operation, especially selective initializing operation, and ensures wiring operation without increasing voltages applied to data electrodes.

The reason why disposing the second sustaining period at least at the end of sustaining period stabilizes initializing discharge has not completely been elucidated; however, the following reasons are considered.

When we focus on the sustaining discharge, as shown in FIG. 6, the waveform of light emission and the timing thereof are largely different between the first sustaining period and the second sustaining period. In the first sustaining period, in discharge cells in which sustaining discharge occurs, self-erase discharge d2 occurs time Tw (μs) after one of the display electrodes (e.g. scan electrode SCNi) is fixed at 0V. Then, when application of voltage to the other of the display electrodes (e.g. sustain electrode SUSi) starts, major discharge d1 occurs. In contrast, in the second sustaining period, major discharge d3 occurs substantially without occurrence of self-erase discharge. Major discharge d3 at this time is larger than major discharge d1 in the first sustaining period.

The reason is described as follows. In the first sustaining period, first, the driving waveform of a pulse applied to one of the display electrodes (e.g. scan electrode SCNi) is lowered from Vm (V) to 0V. This generates self-erase discharge d2, and this self-erase discharge decreases the wall charge accumulated on respective electrodes. Then, major discharge d1 occurs when voltage Vm (V) is applied to the other of the display electrodes (e.g. sustain electrode SUSi). However, at this time, because of the lack of the wall voltage, major discharge d1 itself is weakened. In contrast, in the second sustaining period, while the driving waveform of the pulse applied to one of the display electrodes (e.g. scan electrode SCNi) goes down, the driving waveform of the pulse applied to the other of the display electrodes (e.g. sustain electrode SUSi) goes up. This causes major discharge d3 when or before the self-erase discharge occurs. Thus, with sufficient wall voltage accumulated, major discharge d3 occurs. Therefore, major discharge d3 is larger than major discharge d1.

Based on this idea, the second sustaining period is included at least at the end of the sustaining period. This can accumulate sufficient negative wall voltage on scan electrode SCNi and sufficient positive wall voltage on sustain electrode SUSi and data electrode Dk in a discharge cell in which sustaining discharge has occurred. For this reason, application of a ramp voltage gradually decreasing from voltage Vm (V) to Va (V) to scan electrode SCNi in the selective initializing operation of the following sub-field can generate stable weak discharge between sustain electrode SUSi and scan electrode SCNi, and data electrode Dk and scan electrode SCNi. This weakens the wall voltage on scan electrode SCNi, the wall voltage on sustain electrode SUSi, and the wall voltage on data electrode Dk, thus adjusting the wall voltage to a value appropriate for writing operation. Therefore, writing voltage necessary for the following writing operation can be reduced and stable image display can be assured.

However, for the conventional driving method, the sustaining period is completed in the first sustaining period. Thus, the sustaining discharge is only weak major discharge d1. For this reason, negative wall voltage on scan electrode SCNi, and positive wall voltage on sustain electrode SUSi and data electrode Dk are insufficient. This causes wall charge incomplete for writing operation, such as no initializing discharge, and insufficient charge adjustment even at occurrence of initializing discharge in the initializing period of the following SF. To ensure occurrence of writing discharge, insufficient wall voltage should be compensated. For this reason, higher voltage should be applied to data electrodes.

In a method of driving a panel of the present invention, including the second sustaining period at least at the end of the sustaining period stabilizes the following initializing operation, especially selective initializing operation, and forms wall charge appropriate for writing operation. Incidentally, when the second sustaining period is lengthened to increase the number of sustain pulses in which the transition periods of waveforms applied to scan electrode and sustain electrode are temporally overlapped, the following selective initializing operation can be stabilized. However, when the number of pulses to be temporally overlapped increases to a certain degree, the effect is almost the same. The number of sustain pulses temporally overlapped that are necessary for stabilizing the initializing operation is influenced by a percentage of lit cells in a panel.

Now, in the driving waveforms in the second sustaining period, the transition periods of the pulses applied to scan electrode SCNi and sustain electrode SUSi are temporally overlapped. For this reason, the peak current flowing at charge/discharge of the electrodes is larger than that of the driving waveforms in the first sustaining period. Thus, the power consumed in the resistance of the panel and circuits are larger and reactive power tends to increase. Therefore, it is desirable to minimize the duration of the second sustaining period. For a driving method of the present invention, in a panel 42 in. in diagonal, setting the duration of the second sustaining period so that it includes approx. 5 sustain pulses can stabilize the selective initializing operation. This can inhibit the increase in reactive power within a small range.

To further inhibit the increase in reactive power, a plasma display panel can be structured so that the duration of the second sustaining period is changed according to the percentage of lit discharge cells.

Figure 7:
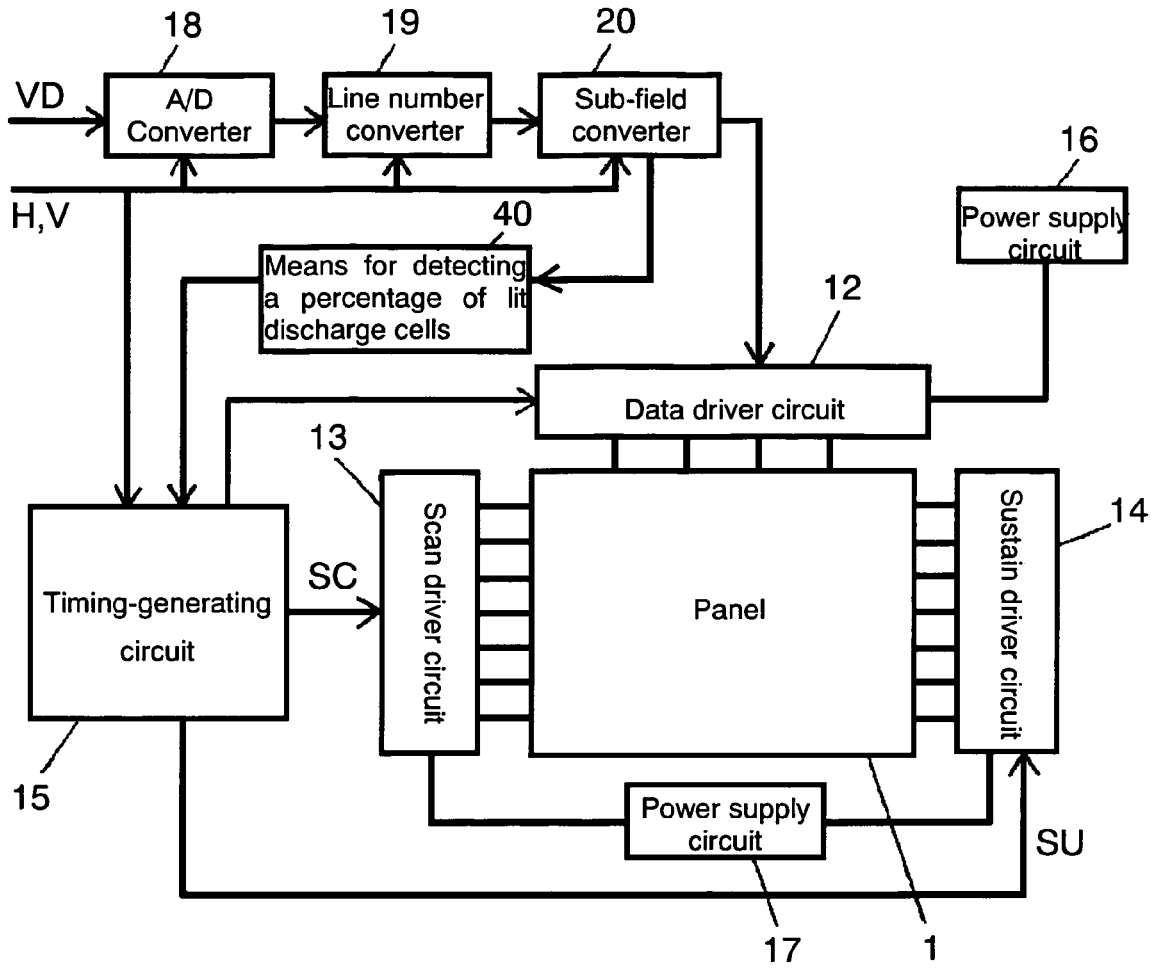
FIG. 7 is a diagram illustrating a structure of a plasma display device for changing duration of a second sustaining period according to a percentage of lit discharge cells in the exemplary embodiment of the present invention.
Figure 8:
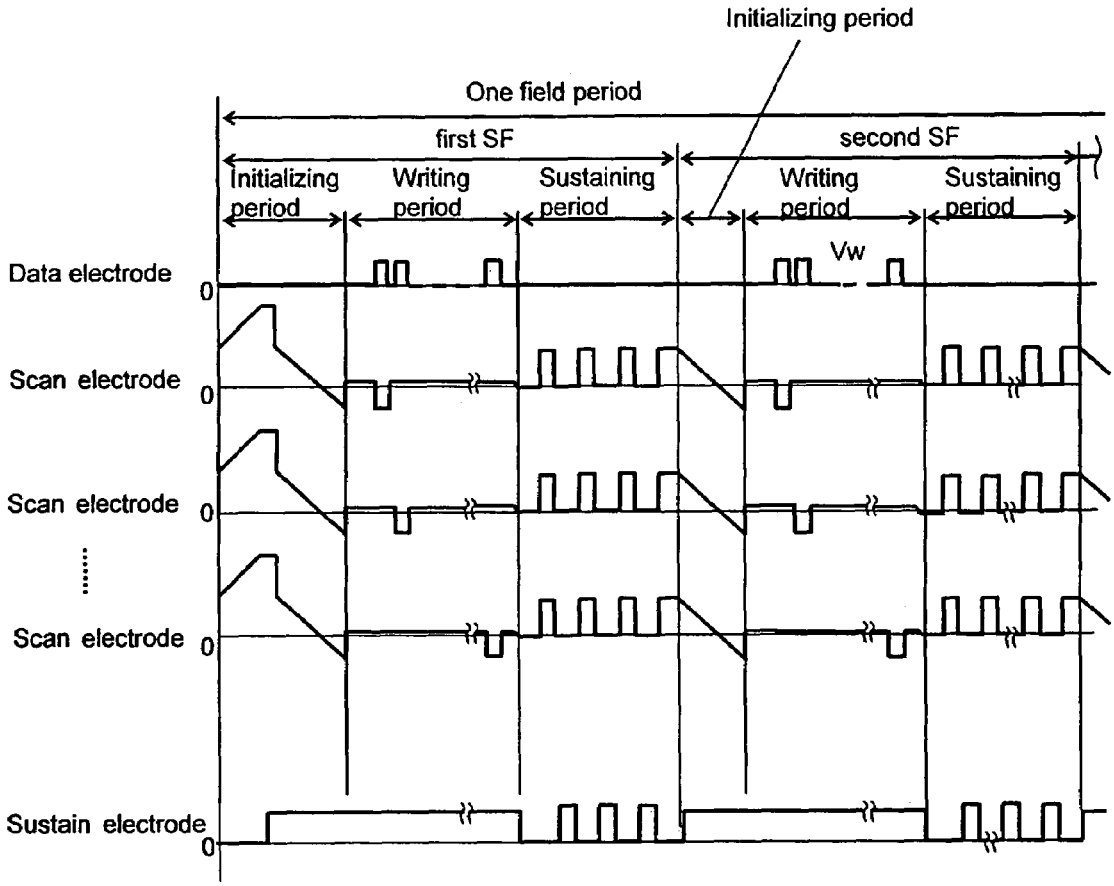
FIG. 8 is a diagram showing driving waveforms of a conventional plasma display panel.

FIG. 7 shows a structure of a plasma display device for changing the duration of the second sustaining period according to the percentage of lit discharge cells. In addition to the structure of a plasma display device shown in FIG. 3, means for detecting a percentage of lit discharge cells 40 is provided. Means for detecting a percentage of lit discharge cells 40 detects a percentage of lit discharge cells with respect to all the discharge cells in each sub-field, according to the data from sub-field converter 20. The percentage of lit cells in each sub-field detected by means for detecting a percentage of lit discharge cells 40 is sent to timing-generating circuit 15. Timing-generating circuit 15 determines the duration of the second sustaining period according to the percentage of lit cells, and controls scan driver circuit 13 and sustain driver circuit 14.

When the percentage of lit discharge cells is small, current flowing through panel 1 and thus voltage drop are small. For this reason, voltage applied to each discharge cell is larger and causes strong discharge. Therefore, because the amount of wall charge provided by the sustaining discharge is relatively large, the following initializing operation can be stabilized even with a small number of sustain pulses temporally overlapped. In contrast, when the percentage of lit discharge cells is large, current flowing through panel 1 and thus voltage drop are large. For this reason, voltage applied to each discharge cell is smaller and causes weak discharge. Therefore, because the amount of wall charge provided by the sustaining discharge is smaller, the number of pulses temporally overlapped must be increased. Thus, when the percentage of lit discharge cells is small, the second sustain period is shortened. When the percentage of lit discharge cells is large, the second sustain period is lengthened. Such a change in the duration of the second sustain period according to the percentage of lit discharge cells can stabilize the initializing operation while minimizing an increase in reactive power.

In FIG. 6, in the second sustaining period, the leading edge period of a sustain pulse applied to one of electrodes (e.g. scan electrode SCNi) is exactly overlapped with the trailing edge period of a sustain pulse applied to the other of the electrodes (e.g. sustain electrode SUSi). However, exact overlapping is not necessarily required. The duration, or period, during which the transition periods of sustain pulses are overlapped with each other in the second sustain period can be set so that a self-erase discharge substantially does not occur.

In the waveforms of FIG. 6, the entire transition periods of a sustain pulse applied to one of the display electrodes are disposed within the low period of a sustain pulse applied to the other of the display electrodes. However, the entire transition periods of the sustain pulse applied to one of the display electrodes can be disposed within the high period of the sustain pulse applied to the other of the display electrode.

In this embodiment, a ramp voltage waveform is used as a driving waveform for causing an initializing discharge in the initializing period. Instead of this ramp voltage waveform, a voltage waveform gently changing with a relative voltage change up to 10V/μs can be used. However, because too small relative voltage change lengthens the initializing period and makes gradation representation difficult, the lower limit of the relative voltage change is set within a range in which a desired gradation representation is possible.

Further, in this embodiment, because initializing discharge occurs in all the cells irrelevant to the state of wall charge in respective discharge cells, in the first SF, the sustaining period of the sub-filed just before the first SF (the last sub-field in one field period) need not have the second sustain period.

As obvious from the above description, a method of driving a plasma display panel of the present invention can cause a stable initializing discharge and display images with high contrast without applying high voltage to data electrodes thereof.

The invention claimed is:

1. A method of driving a plasma display panel including a plurality of discharge cells, each discharge cell being formed at an intersection of a scan electrode and a sustain electrode, and a data electrode, the method comprising:

dividing one field period into a plurality of sub-fields, each comprising an initializing period, a writing period, and a sustaining period;

providing a first sustaining period and a second sustaining period in a sustaining period of at least one sub-field, in the first sustaining period, a transition period of a sustain pulse applied to the scan electrode not being temporally overlapped with a transition period of a sustain pulse applied to the sustain electrode, and in the second sustaining period, the transition period of the sustain pulse applied to the scan electrode being temporally overlapped with the transition period of the sustain pulse applied to the sustain electrode; and disposing the second sustaining period at least at an end of the sustaining period, wherein, the duration of the second sustaining period is changed according to a percentage of lit discharge cells.

* * * * *